US008336386B2

(12) United States Patent
Wang

(10) Patent No.: US 8,336,386 B2
(45) Date of Patent: Dec. 25, 2012

(54) AIR PUMP PRESSURE GAUGE

(75) Inventor: Lopin Wang, Taichung (TW)

(73) Assignee: Beto Engineering and Marketing Co., Ltd., Taichung (TW)

( * ) Notice: Subject to any disclaimer, the term of this patent is extended or adjusted under 35 U.S.C. 154(b) by 190 days.

(21) Appl. No.: 13/011,689

(22) Filed: Jan. 21, 2011

(65) Prior Publication Data

US 2012/0186355 A1 Jul. 26, 2012

(51) Int. Cl.
*G01L 7/16* (2006.01)

(52) U.S. Cl. ..... 73/744; 73/700

(58) Field of Classification Search ..... None
See application file for complete search history.

(56) References Cited

U.S. PATENT DOCUMENTS 3,677,089 A * 7/1972 Martin ..... 73/744
3,981,625 A 9/1976 Wickenberg
4,136,560 A 1/1979 Gellos
4,246,797 A * 1/1981 Myles ..... 73/744
4,246,798 A * 1/1981 Myles ..... 73/744
4,333,491 A * 6/1982 Knubley ..... 137/116.3
4,464,929 A * 8/1984 Willis ..... 73/146.8
4,686,855 A * 8/1987 Smith ..... 73/146.8
4,986,128 A * 1/1991 Burns ..... 73/744
4,998,438 A * 3/1991 Martin ..... 73/146.8
5,779,457 A 7/1998 Chuang et al.
5,819,779 A * 10/1998 Takemura et al. ..... 137/229
6,132,189 A 10/2000 Ward
6,164,139 A * 12/2000 Krimmer ..... 73/744
6,196,807 B1 3/2001 Wu
6,279,599 B1 * 8/2001 Chen ..... 137/228
6,878,204 B1 * 4/2005 Kinnison et al. ..... 118/317
6,978,670 B2 * 12/2005 Cousineau ..... 73/146.8
7,197,919 B2 * 4/2007 Wu ..... 73/146
7,458,270 B2 * 12/2008 Kiefer et al. ..... 73/718
2002/0174723 A1 11/2002 Chuang
2004/0001761 A1 1/2004 Wu
2008/0056922 A1 3/2008 Huang

* cited by examiner

*Primary Examiner* — Lisa Caputo
*Assistant Examiner* — Jermaine Jenkins
(74) *Attorney, Agent, or Firm* — Muncy, Geissler, Olds & Lowe, PLLC

(57) ABSTRACT

An air pump pressure gauge includes a casing, an inner tube coaxially affixed to the casing and defining with the casing an accommodation chamber, a movable member movable back and forth in the accommodation chamber, an end cap end cap set between the inner tube and the casing to seal one end of the accommodation space, a spring member stopped between the end cap and the movable member, at least one seal member mounted on the movable member to define a first airtight structure between the outer surface of the inner tube and the at least one seal member and a second airtight structure between the inside wall of the casing and the at least one seal member, an air hole in communication between the axial hole of the inner tube and the accommodation space, a longitudinal sliding slot located on the movable member, a rack extending along one side of the longitudinal sliding slot, a rotating axle inserted through the longitudinal sliding slot and having its inner end pivoted to the inner tube and its outer end extending out of the casing and a middle part thereof mounted with a gear being meshed with the rack, a pointer fixedly connected to the outer end of the rotating axle outside the casing, a graduation scale mounted on the casing below the pointer, and a transparent cover covering the graduation scale and the pointer.

6 Claims, 8 Drawing Sheets

AIR PUMP PRESSURE GAUGE

BACKGROUND OF THE INVENTION

1. Field of the Invention

The present invention relates to a pressure measurement apparatus and more specifically, to an air pump pressure gauge.

2. Description of the Related Art

Many prior art designs of air pump with pressure gauge are known. Exemplars are seen.

U.S. Pat. No. 3,981,625 discloses an air pump in which a transparent handle and a piston are configured to form a pressure gauge.

U.S. Pat. No. 5,779,457 discloses a view window type pressure gauge.

U.S. Pat. No. 6,132,189 discloses an attached pressure gauge.

U.S. Pat. No. 6,196,807B1 also discloses a view window type pressure gauge.

US2002/0174723A1 discloses an electronic pressure gauge.

US2004/0001761A1 discloses an attached analog pressure gauge.

US2008/0056922A1 discloses an analog pressure gauge.

U.S. Pat. No. 4,136,560 discloses a pressure gauge.

In a conventional air pump with an analog pressure gauge, the analog pressure gauge is attached to the outside of the housing of the air pump that may interfere with the user's operation in pumping the air pump.

In a conventional air pump with a view window type pressure gauge, a small tubular passage protrudes over the outside wall of the air pump casing for accommodating the pressure gauge. Due to the limitation of the outer diameter of the air pump, the view window is small, not facilitating viewing of the readings.

In U.S. Pat. No. 4,136,560, the pressure gauge is directly connected to, for example, the air valve of the vehicle tire. Due to this installation limitation, the structural size is limited. In consequence, the pressure indication is not apparent.

The pressure value indication of U.S. Pat. No. 3,981,625 is large enough for easy reading without interfering with the pumping operation, however, it does not allow measurement of the pressure during pumping. When measuring the air pressure, the user must release the handle and wait for a certain period of time and then view the graduations on the handle. This design is inconvenient to use.

SUMMARY OF THE INVENTION

The present invention has been accomplished under the circumstances in view. It is the main object of the present invention to provide an air pump pressure gauge, which is kept inside the body of the air pump to indicate the pressure value clearly without interfering with the pumping operation, allowing the user to view and read the readings conveniently.

To achieve this and other objects of the present invention, an air pump pressure gauge, used in an air pump, comprises a casing shaped like a tube; an inner tube coaxially and fixedly mounted ins aid casing and defining with the casing an annular accommodation space, the inner tube having one end thereof connected to an air nozzle assembly of the air pump and an opposite end thereof kept in air communication with an air-pumping passage of the air pump; a movable member being an annular member sleeved onto the inner tube within the casing and movable back and forth in the annular accommodation space; a spring member installed in the annular accommodation space and stopped between one end of the annular accommodation space and the movable member to provide a return force to the movable member toward an opposite end wall of the annular accommodation space; at least one seal member mounted on the movable member to define a first airtight structure between the outer surface of the inner tube and the at least one seal member and a second airtight structure between the inside wall of the casing and the at least one seal member; an air hole located on the inner tube between the first airtight structure and the opposite end wall of the annular accommodation space for allowing air to pass from the inner tube into the annular accommodation space to move the movable member; a longitudinal sliding slot located on the movable member; a rack located on the movable member and extending along one side of the longitudinal sliding slot; a rotating axle radially extending through the casing and the annular accommodation space, the rotating axle having an inner end thereof pivotally connected to the inner tube and an outer end thereof extending out of the casing and a middle part thereof fixedly mounted with a gear being meshed with the rack of the movable member so that moving the movable member along the axis of the inner tube causes rotation of the rotating axle forwardly/backwardly; a pointer fixedly connected to the outer end of the rotating axle and suspending outside the casing; a graduation scale mounted on the outside of the casing below the pointer; and a transparent cover fastened to the casing and covered over the graduation scale and the pointer.

As the pressure gauge is kept inside the casing, it does not interfere with the pumping operation. The pressure indicating structure is large enough to facilitate reading. Further, the pressure indicating structure is large enough to clearly indicate the pressure value, facilitate reading.

DETAILED DESCRIPTION OF THE INVENTION

Three examples of the invention will be described hereinafter for understanding of the spirit and scope of the invention.

Figure 1:
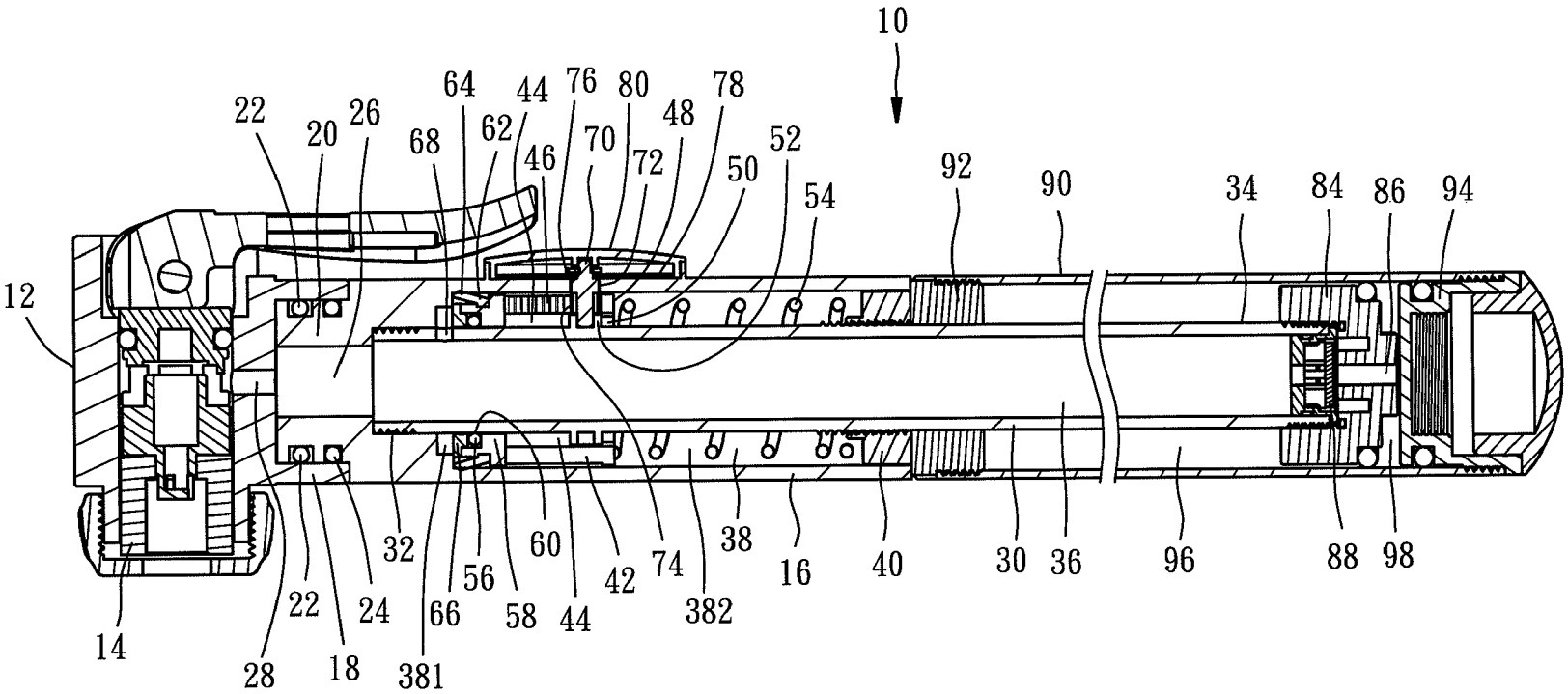
FIG. 1 is a sectional view of an air pump in accordance with a first embodiment of the present invention, illustrating the initial status.
Figure 2:
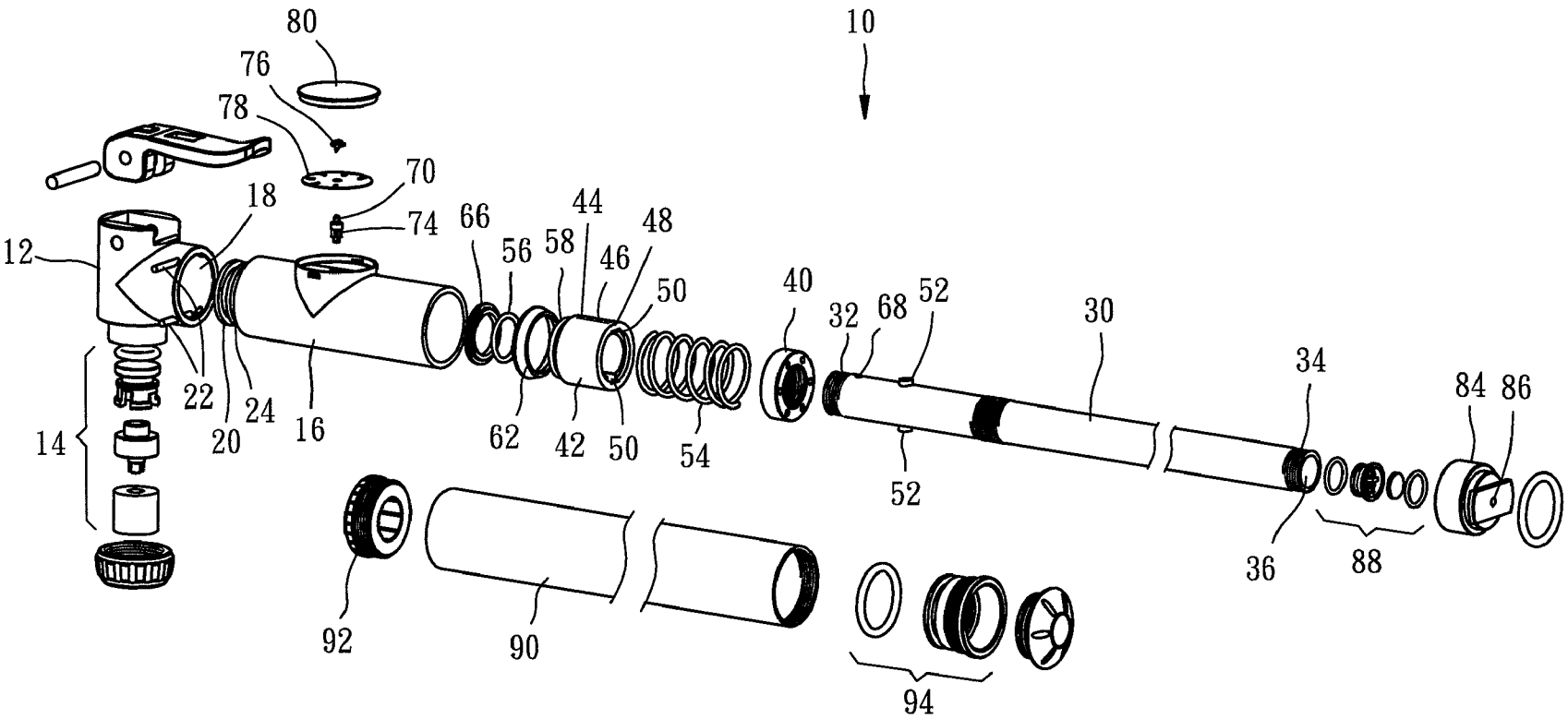
FIG. 2 is an exploded view of the air pump in accordance with the first embodiment of the present invention.

Referring to FIGS. 1 and 2, a handheld air pump 10 in accordance with a first embodiment of the invention is shown comprising:

a pump head 12 holding therein an air nozzle assembly 14, which is a known design and therefore no further description in this regard is necessary, having a coupling portion 18 located on one side thereof;

a casing 16 shaped like a tube and fixedly connected to the pump head 12, having a connection end portion 20 located on its one end and mounted with an O-ring 24 and then fastened to the coupling portion 18 of the pump head 12 with two pins 22 and defining therein an axial through hole 26 in communication with an air hole 28 in the coupling portion 18 of the pump head 12;

an inner tube 30 having one end 32 thereof coaxially fastened to the inside of the connection end portion 20 of the casing 16, two protrusions 52 raised from the periphery thereof at two opposite sides and an opposite end thereof extending out of the casing 16 to work as an axle (air-pumping passage) of the handheld air pump 10 such that the axial hole 36 of the inner tube 30 is in communication with the air hole 28 via the axial through hole 26 and an annular accommodation space 38 is defined within the casing 16 around the inner tube 30;

an end cap 40 being an annular member sleeved onto the inner tube 30 within the casing 16 to seal one end of the annular accommodation space 38;

a movable member 42 being an annular member sleeved onto the inner tube 30 within the casing 16 to divide the annular accommodation space 38 into a first accumulation chamber 381 and a second accumulation chamber 382, having at least one, for example, two longitudinal sliding slots 44 spaced from each other at 180°, a rack 46 extending along one side of one longitudinal sliding slot 44, two notches 50 respectively located on the inside wall 48 of the movable member 42 at one end of each of the two longitudinal sliding slots 44 for the passing of the protrusions 52 of the inner tube 30 so that the matching arrangement of the protrusions 52 and the longitudinal sliding slots 44 provide a function to prohibit rotation of the movable member 42 (it is to be understood that one single longitudinal sliding slot 44 with one single protrusion 52 can achieve the same effect, however this design has a directional installation limitation; the design of two longitudinal sliding slot with two protrusions has no direction limitation in installation);

a spring member 54 installed in the second accumulation chamber 382 and stopped with its one end against the end cap 40 and its other end stopped against the movable member 42 to provide a return force after movement of the movable member 42 toward the end 32 of the inner tube 30;

a first seal member 56 being an O-ring mounted on the other end 58 of the movable member 42 such that a first airtight structure 60 is formed between the outer surface 30 and the first seal member 56;

a second seal member 62 shaped like a horn and fastened to the other end 58 of the movable member 42 such that a second airtight structure 64 is formed between the second seal member 62 and the inside wall of the casing 16;

a locating member 66 located on the other end 58 of the movable member 42 to hold down the first seal member 56 on the movable member 42;

an air hole 68 located on the inner tube 30 and abutted to the inside wall of the connection end portion 20 of the casing 16 between the first airtight structure 60 and the inside wall of the connection end portion 20 for communication between the inner tube 30 and the first accumulation chamber 381;

a rotating axle 70 radially inserted through a through hole 72 on the casing 16 and the annular accommodation space 38 in the casing 16 and the longitudinal sliding slots 44 of the movable member 42, having its inner end pivotally connected to the protrusions 52 of the inner tube 30 and its outer end extending out of the casing 16 and a gear 74 fixedly mounted on the middle between its inner and outer ends and meshed with the rack 46 of the movable member 42 such that moving the movable member 42 along the axis of the inner tube 30 causes rotation of the rotating axle 70 forwardly or backwardly;

a pointer 76 fixedly connected to the outer end of the rotating axle 70 and suspending outside the casing 16;

a graduation scale 78 mounted on the outside wall of the casing 16 below the pointer 76; and a transparent cover 80 fastened to the casing 16 and covered over the graduation scale 78 and the pointer 76.

The above description explains the structure of an air pump pressure gauge of the air pump 10. The other structure of the air pump 10 is briefly described hereinafter.

The inner tube 30 has a piston 84 affixed to its other end 34. The piston 84 has a center through hole 86 in communication with the axial hole 36 of the inner tube 30 and a one-way valve 88 mounted in the center through hole 86 for allowing air to pass through the center through hole 86 into the axial hole 36 of the inner tube 30 and prohibiting air from flowing in the reversed direction. An outer tube 90 is sleeved onto the piston 84, having an end piece 92 mounted on its one end and facing the casing 16 and an one-way valve 94 mounted on its other end to let outside air enter the outer tube 90 through the one-way valve 94 and to prohibit inside air from flowing out of the outer tube 90 through the one-way valve 94. According to this embodiment, the piston 84 is also a one-way valve. The piston 84 divides the inside space of the outer tube 90 into a first air chamber 96 and a second air chamber 98, simply allowing air to pass from the first air chamber 96 into the second air chamber 98. When the outer tube 90 is pulled outwards, the volume of the second air chamber 98 expands for letting in outside air. When the outer tube 90 is pushed inwards, air in the second air chamber 98 is compressed and forced to flow into the inside of the inner tube 30.

Figure 3:
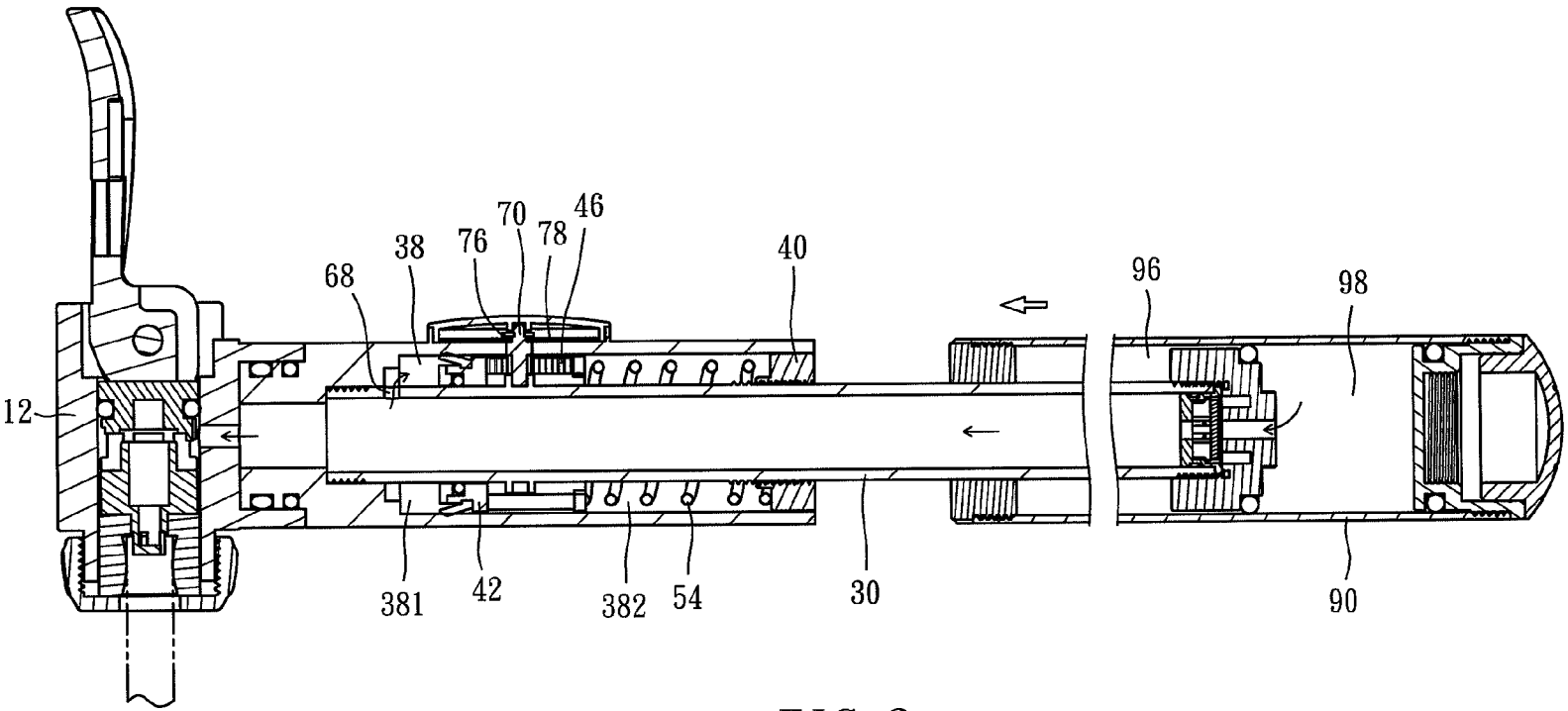
FIG. 3 is similar to FIG. 1, illustrating a pumping status.
Figure 4:
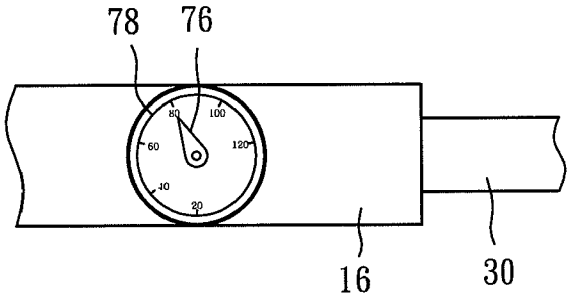
FIG. 4 is a top view of the pressure gauge shown in FIG. 3, illustrating a pressure measuring status.

As shown in FIG. 3, when the pump head 12 is attached to the air valve (see the imaginary line) of the object to be inflated (for example, a tire) and the outer tube 90 is reciprocated, the compressed air in the inner tube 30 will flow through the air hole 68 located on the inner tube 30 and abutted to the inside wall of the connection end portion 20 of the casing 16 between the first airtight structure 60 and the inside wall of the connection end portion 20 for communication between the inner tube 30 and the first accumulation chamber 381 to push the movable member 42 toward the end cap 40 to compress the spring member 54, storing a return spring force. When the inside pressure of the inflated object rises, the amount of displacement of the movable member 42 is relatively increased. Displacement of the movable member 42 causes the rack 46 to drive the rotating axle 70 to rotate, and therefore the pointer 76 is biased relative to the graduation scale 78 to indicate the pressure value of the inflated object (see FIG. 4).

Figure 5:
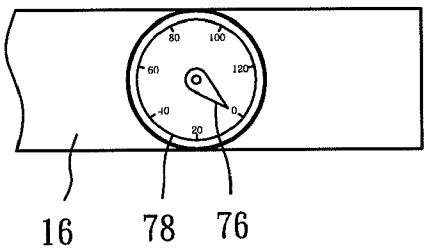
FIG. 5 is a top view of the pressure gauge shown in FIG. 1, illustrating the still (start) status.

After inflation or measurement, remove the pump head 12 from the air valve of the inflated object to discharge the compressed air out of the inner tube 30, allowing the spring member 54 to return the movable member 42 to its former (start) position (see FIG. 1), and at the same time, the rack 46 of the movable member 42 reverses the rotating axle 70 to bias the pointer 76 to its former (start) position, i.e., the zero-reading position (see FIG. 5).

According to this embodiment, the one-way valve 88 is mounted in the piston 84 so that no any interference exists between the pump head 12 and the pressure gauge, and the pressure gauge can directly measures the pressure value of the inflated object. In a conventional air pump without pressure gauge, this one-way valve 88 is normally installed in a through hole 28 in the pump head 12.

In this embodiment, the protrusions 52 and notches 50 and the longitudinal sliding slots 44 constitute a sliding groove and rail structure to prohibit rotation of the movable member 42. Simply the matching arrangement of the rotating axle 70 and the longitudinal sliding slots 44 can achieve the same effect to prohibit rotation of the movable member 42.

Figure 6:
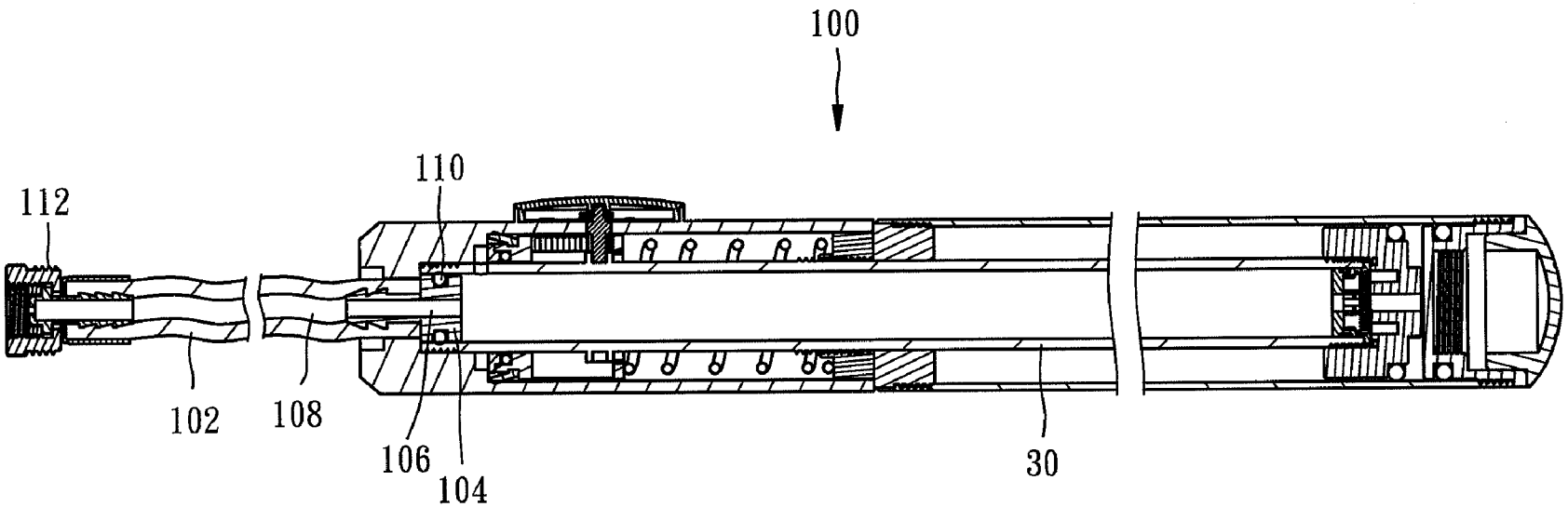
FIG. 6 is a sectional view of is an air pump in accordance with a second embodiment of the present invention.
Figure 7:
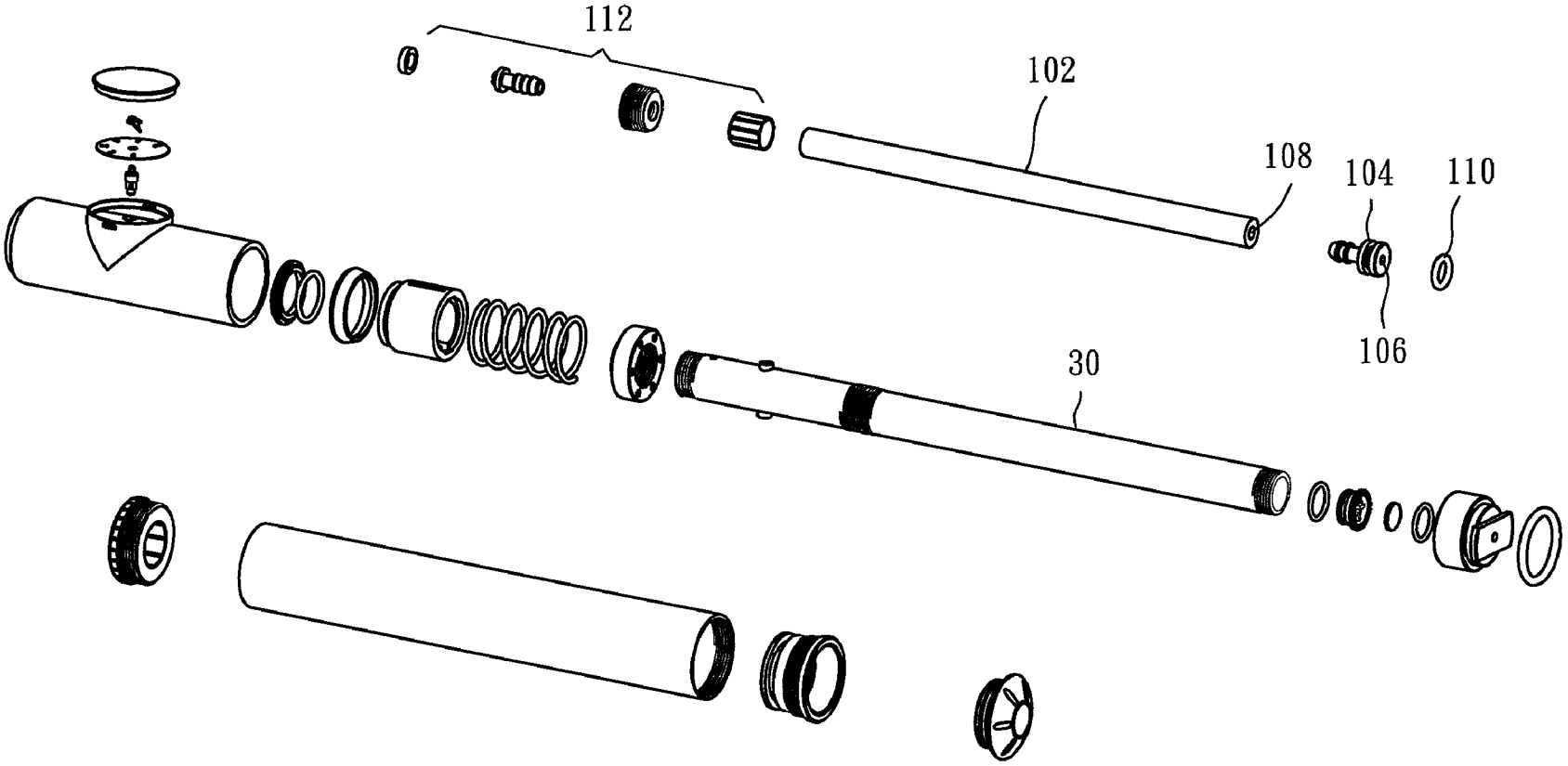
FIG. 7 is an exploded view of the air pump in accordance with the second embodiment of the present invention.

FIGS. 6 and 7 illustrate the structure of a second embodiment of the present invention, in which like reference signs denote like component parts. According to this second embodiment, the air pump 100 and another air pump pressure gauge eliminates the pump head 12 of the aforesaid first embodiment. As illustrated, a flexible tube 102 is set in the inner tube 30, having an end plug 104 fastened to its inner end. The end plug 104 has a center through hole 106 in communication with the axial hole 108 of the flexible tube 102, and is peripherally mounted with an O-ring 110 that is tightly kept in contact with the inside wall of the inner tube 30 to seal the gap. The outer end of the flexible tube 102 is mounted with a valve connector 112 for connection to the air valve of the object to be inflated. When using the air pump 100, pull the flexible tube 102 out of the inner tube 30. When not in use, push the flexible tube 102 back to the inside of the inner tube 30.

Figure 8:
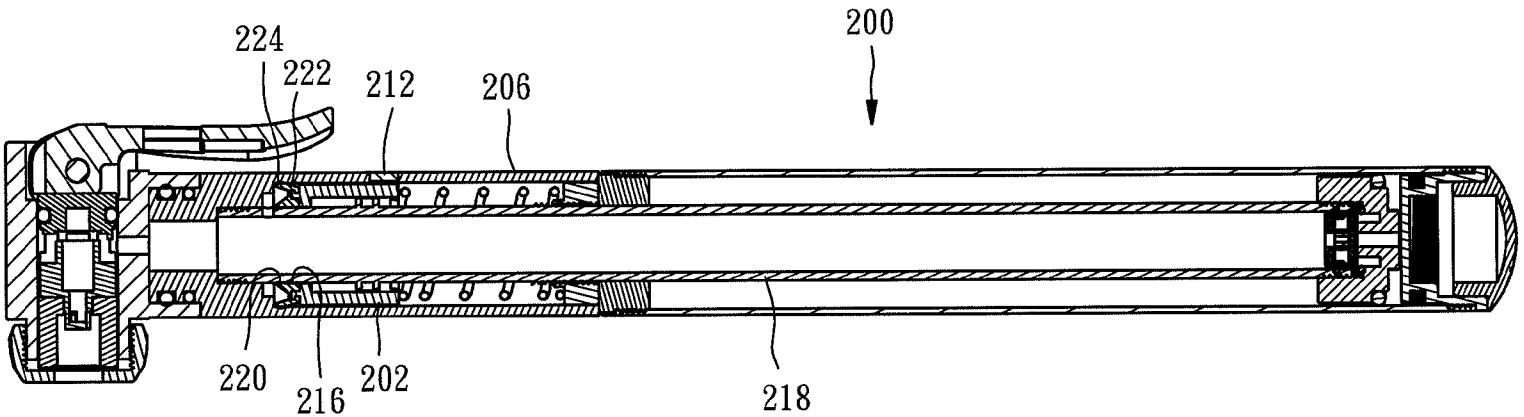
FIG. 8 is a sectional view of is an air pump in accordance with a third embodiment of the present invention.
Figure 9:
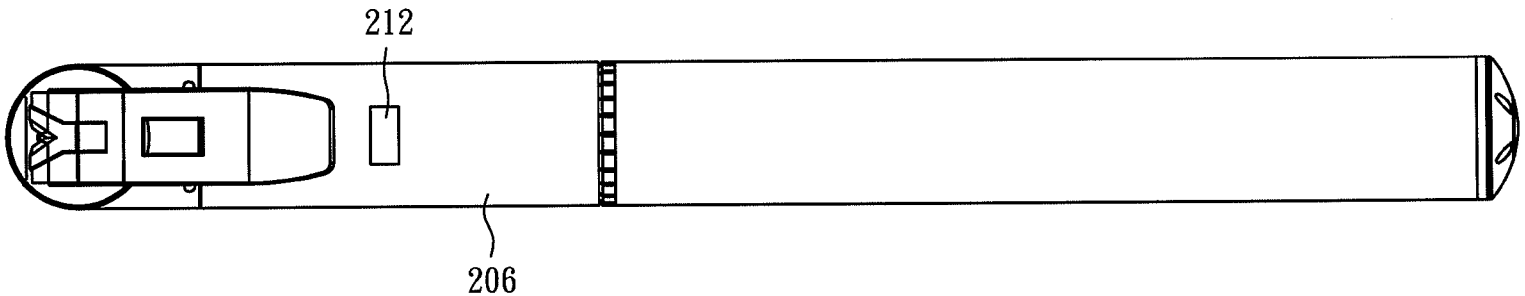
FIG. 9 is a top view of FIG. 8.
Figure 10:
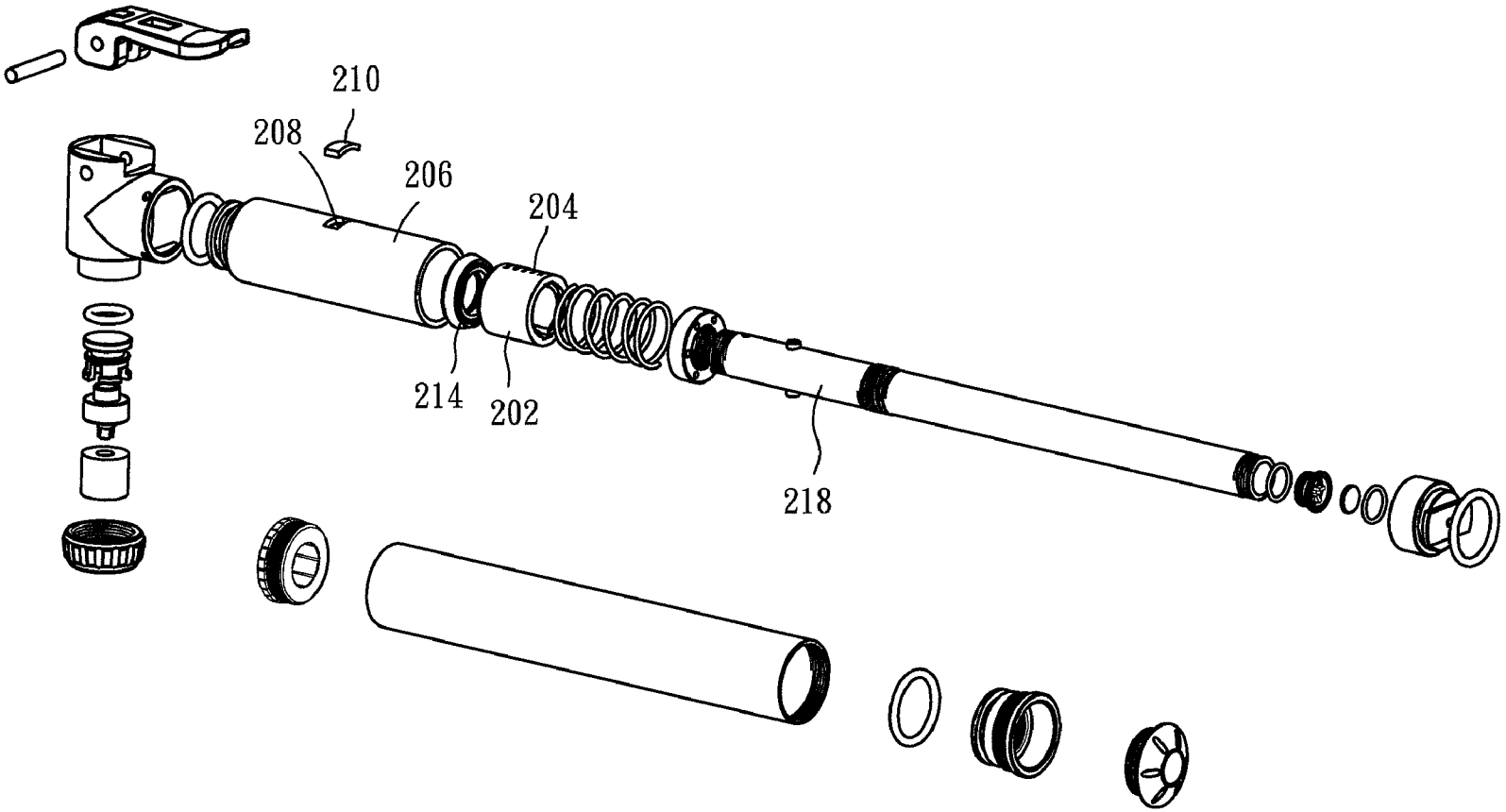
FIG. 10 is an exploded view of the air pump in accordance with the third embodiment of the present invention.

FIGS. 8-10 illustrate the structure of a third embodiment of the present invention. According to this third embodiment, the air pump 200 and still another air pump pressure gauge eliminates is substantially similar to the aforesaid first embodiment with the exception that this third embodiment eliminates the aforesaid rotating axle 70 and pointer 76 and the aforesaid longitudinal sliding slots 44 are eliminated from the movable member 202. According to this third embodiment, an elongated graduation scale 204 is located on the periphery of the movable member 202. The casing 206 has a peephole 208 corresponding to the graduation scale 204. A transparent member 210 (acrylic or glass member) is mounted in the peephole 208, forming a view window 212 through which one can read the readings of the graduation scale 204. Further, a seal member 214 is attached to the front end of the movable member 202. The seal member 214 has an inner lip 216 that forms with the inner tube 218 a first sealing structure 220, and an outer lip 222 that forms with the inside wall of the casing 206 a second sealing structure 224. This seal member 214 is a known structure. It can also be used in the aforesaid first or second embodiment.

The main advantage of the present invention is that the pressure gauge is kept inside the casing without interfering with the pumping operation; the annular movable member receives the pressure of the inflated object, and its sensitivity is directly proportional to its pressure-receiving surface area; the pressure indicating structure is large enough to facilitate reading.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. An air pump pressure gauge for use in an air pump, comprising:

a casing shaped like a tube;

an inner tube coaxially and fixedly mounted in said casing and defining with said casing an annular accommodation space, said inner tube having one end thereof connectable to an air nozzle assembly of an air pump and an opposite end thereof kept in air communication with an air-pumping passage of the connected air pump and an axial hole defined therein in communication between the two ends thereof;

a movable member being an annular member sleeved onto said inner tube within said casing and movable back and forth in said annular accommodation space;

a spring member installed in said annular accommodation space and stopped between one end of said annular accommodation space and said movable member to provide a return force to said movable member toward an opposite end wall of said annular accommodation space;

at least one seal member mounted on said movable member to define a first airtight structure between the outer surface of said inner tube and said at least one seal member and a second airtight structure between the inside wall of said casing and said at least one seal member;

an air hole located on said inner tube between said first airtight structure and the opposite end wall of said annular accommodation space for allowing air to pass from said inner tube into said annular accommodation space to move said movable member;

a longitudinal sliding slot located on said movable member;

a rack located on said movable member and extending along one side of said longitudinal sliding slot;

a rotating axle radially extending through said casing and said annular accommodation space, said rotating axle having an inner end thereof pivotally connected to said inner tube and an outer end thereof extending out of said casing and a middle part thereof fixedly mounted with a gear being meshed with said rack of said movable member so that moving said movable member along the axis of said inner tube causes rotation of said rotating axle forwardly/backwardly;

a pointer fixedly connected to the outer end of said rotating axle and suspending outside said casing;

a graduation scale mounted on the outside of said casing below said pointer; and a transparent cover fastened to said casing and covered over said graduation scale and said pointer.

2. The air pump pressure gauge as claimed in claim 1, wherein the opposite end of said inner tube extends out of said casing and providing an air-pumping passage; an annular end cap is set in between said inner tube and said casing to seal one end of said annular accommodation space; said spring member is stopped between said annular end cap and said movable member.

3. The air pump pressure gauge as claimed in claim 1, wherein said inner tube comprises a protrusion; said movable member comprises a notch located on an inside wall thereof and adapted for the passing of said protrusion for; the inner end of said rotating axle is pivotally connected to said protrusion.

4. The air pump pressure gauge as claimed in claim 3, further comprising a piston fixedly mounted in the opposite end thereof, said piston comprising a center through hole in communication with the axial hole of said inner tube and a one-way valve mounted in the center through hole for allowing air to pass therethrough into the axial hole of said inner tube and prohibiting air from flowing in the reversed direction, and an outer tube sleeved onto said piston, said outer tube having one end thereof mounted with an end piece and facing said casing and an opposite end thereof mounted with a one-way valve to let outside air enter said outer tube and to prohibit reverse flowing of the inside air toward the outside.

5. The air pump pressure gauge as claimed in claim 4, wherein said casing has one end thereof fixedly mounted with a pump head, said pump head having installed therein said air nozzle assembly.

6. The air pump pressure gauge as claimed in claim 3, further comprising a flexible tube connected between one end of said inner tube and said air nozzle assembly of said air pump.

* * * * *